252-99 AU 166 EX
OR 4,284,524

United States Patent [19]

Gilbert

[11] 4,284,524

[45] Aug. 18, 1981

[54] ALKALINE DISHWASHER DETERGENT

[75] Inventor: Lawrence A. Gilbert, Fairfield, Ohio

[73] Assignee: The Procter & Gamble Company, Cincinnati, Ohio

[21] Appl. No.: 164,710

[22] Filed: Jun. 30, 1980

[51] Int. Cl.[3] ..... C11D 7/56; C11D 7/40

[52] U.S. Cl. ..... 252/99; 252/95; 252/98; 252/174.24

[58] Field of Search ..... 252/99, 95, 98, 187 C, 252/174.24

[56] References Cited

U.S. PATENT DOCUMENTS

| | | | |
|---|---|---|---|
| T995,003 | 6/1980 | Zimmerman | 252/98 X |
| 4,144,226 | 3/1979 | Crutchfield et al. | 252/174.24 |
| 4,146,495 | 3/1979 | Crutchfield et al. | 252/174.24 |

*Primary Examiner*—Mayer Weinblatt

*Attorney, Agent, or Firm*—Robert B. Aylor; Richard C. Witte; Thomas H. O'Flaherty

[57] ABSTRACT

Alkaline dishwasher detergent composition having a specific low level of a polyacetal carboxylate for improved hard water filming performance, especially in the presence of precipitating builders. The detergent composition is substantially free of highly alkaline materials and other organic builders.

9 Claims, No Drawings

ALKALINE DISHWASHER DETERGENT

TECHNICAL FIELD

This invention relates to detergent compositions which are particularly suitable for use in automatic dishwashers. Such compositions are normally alkaline, contain low levels of low foaming surfactants, and contain a source of available chlorine. In order to obtain improved cleaning performance, the prior art compositions often contain a source of alkalinity which gives a pH greater than 12 at a 1% concentration, or large amounts of phosphate builders, or organic builders. However, it is known that sources of alkalinity such as alkali metal metasilicates and alkali metal hydroxides are relatively unsafe for inclusion in large amounts in a consumer product. Also, it is desirable to try to lower the amount of phosphorus contained in such compositions.

DISCLOSURE OF THE INVENTION

This invention is based upon the discovery that a polyacetal carboxylate detergency builder, when used at a low level in conventional, automatic dishwasher compositions can give surprisingly improved hard water filming performance, especially in the presence of precipitating detergency builders such as carbonates and orthophosphates. More specifically, this invention relates to automatic dishwasher compositions providing optimum cleaning, spotting and filming performance and consisting essentially of:

(1) from about 20% to about 70%, preferably from about 25% to about 50%, of a detergency builder selected from the group consisting of alkali metal (e.g., sodium or potassium) tripolyphosphates, pyrophosphates, orthophosphates, carbonates and mixtures thereof;

(2) from about 10% to about 30% silicate solids representing from about 5% to about 15%, preferably from about 8% to about 12% of $SiO_2$, the silicate being a mixture of alkali metal (sodium or potassium, preferably sodium) silicates of which from about 2% to about 15%, preferably from about 4% to about 12% based on the total formula can be present as hydrous silicate having an $SiO_2:M_2O$ ratio of from about 2.0 to about 3.2, preferably 2.4, and a solids content of from about 75% to about 85% and the remainder of the silicate can be a mixture of 2.0r and 3.0 to 3.6r, preferably 3.2r, silicates with from about 15% to about 50% of the total $SiO_2$, preferably from about 25% to about 40% of the $SiO_2$ being provided by 2.0r silicate and from about 10% to about 50%, preferably from about 25% to about 40% of the $SiO_2$ being higher ratio silicates, and wherein M is selected from the group consisting of Na and K;

(3) available chlorine at a level of from about 0.5% to about 3%, preferably from about 0.7% to about 1.5%;

(4) from about 1% to about 9.5%, preferably from about 3% to about 8%, most preferably from about 4% to 6%, of a low foaming nonionic surfactant; and (5) from about 1% to about 30% of a stabilized water-soluble polymer comprising polyacetal carboxylate segments having the structure $$\left(\begin{array}{c}CHO\\ |\\ COOM\end{array}\right)_n,$$

wherein M is selected from the group consisting of alkali metal, ammonium, tetraalkyl ammonium and alkanol amine groups having from 1 to about 4 carbon atoms in the alkyl and alkanol chains; n averages at least 4; and the total number of polyacetal carboxylate segments comprise at least 50% by weight of the total polymer;

said composition having a pH of from about 9 to 10.9 at 2,500 ppm and being substantially free, i.e., less than about 10%, preferably less than about 5%, and most preferably entirely free of materials having a pH of 12 or more at a concentration of 1% in water and also being substantially free, i.e., less than about 10%, preferably completely free of other organic chelating builders.

The above compositions give improved cleaning and especially hard water filming performance even when using less phosphorus and less very highly alkaline materials than is required by the prior art to give equivalent levels of performance.

DETAILED DESCRIPTION OF THE INVENTION

The Detergency Builder

It is desirable that at least 20% of the composition is either sodium or potassium tripolyphosphate or sodium or potassium pyrophosphate or mixtures thereof in order to provide good cleaning and spotting and filming (S/F) results. Since it is desirable to keep the phosphorus content of the composition as low as possible, it is preferred to use a level of from about 20% to about 35%, preferably 25% to 30%, of these sequestering phosphate builders although increased levels up to 50% provide performance benefits. As the amount of sequestering phosphate builder is reduced below about 20%, the level of performance drops off drastically. In general, one would like to use as much sequestering phosphate builder as possible given the limits that are permitted in formulation. The preferred sequestering phosphate builder is sodium tripolyphosphate.

In addition to serving as a sequestering builder, sequestering phosphate builders also are sources of alkalinity and buffering materials. They also are major sources of hydration capacity which assists in making the composition free-flowing initially and maintaining the free-flowing characteristics during storage.

The composition may also contain from about 5% to up to about 20% of trisodium orthosphosphate as chlorinated trisodium orthophosphate.

The term "chlorinated trisodium phosphate" designates a composition consisting of trisodium phosphate and sodium hypochlorite in intimate association in the crystalline form. The chlorinated trisodium phosphate can contain from 1% to 5% available chlorine calculated on the basis of the hydrated material and can conveniently be prepared by the methods of U.S. Pat. Nos. 1,555,474 or 1,965,304 or modifications thereof, incorporated herein by reference. It is preferable to avoid using the chlorinated trisodium phosphate and incorporate an organic chlorine bleach component.

Other builders include sodium and potassium carbonate which are sources of alkalinity (buffers) in the proper pH range. When precipitating builders are present, especially in relatively large amounts, e.g., from about 5 to about 25%, the polyacetal polycarboxylate provides improved filming results in hard water.

The Source of Available Chlorine

The source of available chlorine is a chlorine bleach component, a compound which contains chlorine in active form. Such compounds are often characterized as hypochlorite compounds and are well known as a class. It has been found that the compositions of this invention should have a source of available chlorine in an amount sufficient to provide available chlorine equal to about 0.5% to about 3% by weight of the composition. A more preferred level is from about 0.7% to about 1.5% by weight of the composition. A high level of available chlorine helps the cleaning, especially on starchy soils, and improves spotting and filming.

As stated before, a source of available chlorine is chlorinated trisodium phosphate. However, other materials which can be used are: sodium and potassium dichloroisocyanurates, dichloroisocyanuric acid; 1,3-dichloro-5,5-dimethylhydantoin; N,N'-dichlorobenzoylene urea; paratoluene sulfodichloroamide; trichloromelamine; N-chloroammeline; N-chlorosuccinimide; N,N'-dichloroazodicarbonamide; N-chloroacetyl urea; N,N'-dichlorobiuret; chlorinated dicyandiamide; sodium hypochlorite; calcium hypochlorite; and lithium hypochlorite. Of the other materials sodium, dichloroisocyanurate dihydrate is preferred for effectiveness, stability, availability, etc.

The Silicate

The compositions of this invention contain from about 5% to about 15%, preferably from about 8% to about 12%, of $SiO_2$ as a mixture of sodium or potassium silicates, preferably sodium silicates. These alkali metal silicate solids comprise from about 10% to about 30% of the composition. From about 2% to about 15%, preferably from about 4% to about 12% by weight of the composition can be a hydrous silicate having a ratio of $SiO_2$:$M_2O$ (M=Na or K) of from about 2 to about 3.2, preferably 2.4 and a solids content of from about 75% to about 85%. This hydrous silicate at the indicated levels provides $SiO_2$ and can provide a desirable balance between agglomerating characteristics and the ability to form free-flowing, noncaking agglomerates while avoiding formation of excessive insolubles. Also, it can be desirable to incorporate anhydrous silicate according to the teachings of U.S. Pat. No. 4,077,897, Gault, incorporated herein by reference. It is also desirable to use as much two ratio (2.0r) silicate as possible for best overall performance as far as spotting and filming (S/F) is concerned on metal surfaces, as disclosed in U.S. Pat. No. 4,199,468 of Barford et al, said patent being incorporated herein by reference. However, in order to provide good materials protection, it is desirable to have at least 10% and up to 50% of the total $SiO_2$ present in the composition as the higher ratio (3.0r to 3.6r) silicate, preferably a 3.2r silicate.

The Surfactant

At least about 1%, and not more than about 9.5%, of a low sudsing surfactant is required in order to provide optimum cleaning and S/F (spotting and filming characteristics). A preferred level of surfactant is from about 3% to about 8% and an even more preferred level of surfactant is from about 4% to about 7% by weight of the composition. Preferably, the surfactant is a conventional alkoxylated, preferably ethoxylated, nonionic surfactant and preferably the composition is essentially free of sulfonated or sulfated anionic surfactants.

Examples of nonionic surfactants include:

(1) the condensation product of 1 mole of a saturated or unsaturated, straight or branched chain, alcohol or fatty acid containing from about 10 to about 20 carbon atoms with from about 4 to about 50 moles of ethylene oxide. Specific examples of such compounds include a condensation product of 1 mole of coconut fatty acid or tallow fatty acid with 10 moles of ethylene oxide; the condensation of 1 mole of oleic acid with 9 moles of ethylene oxide; the condensation product of 1 mole of stearic acid with 25 moles of ethylene oxide; the condensation product of 1 mole of tallow fatty alcohols with about 9 moles of ethylene oxide; the condensation product of 1 mole of oleyl alcohol with 10 moles of ethylene oxide; the condensation product of 1 mole of $C_{19}$ alcohol and 8 moles of ethylene oxide; and the condensation product of one mole of $C_{18}$ alcohol and 9 moles of ethylene oxide.

The condensation product of a fatty alcohol containing from 17 to 19 carbon atoms, and being substantially free of chain lengths above and below these numbers, with from about 6 to about 15 moles, preferably 7 to 12 moles, most preferably 9 moles, of ethylene oxide provides superior spotting and filming performance and organic bleach compatability. More particularly, it is preferred that the fatty alcohol contain 18 carbon atoms and be condensed with from about 7.5 to about 12, preferably about 9, moles of ethylene oxide. It is even more preferred if the distribution of ethylene oxide condensation products is such as to give more than about 40%, preferably more than about 50% of the product within plus or minus two ethylene oxide moieties from the average. The preferred product contains less than about 2% unethoxylated alcohol and more than about 70% of the product should contain less than about 10 ethoxy moieties. This distribution of ethylene oxide analogs can be obtained by using a high level of a very strong alkaline catalyst such as sodium metal or sodium hydride in e.g., a 1:1 molar ratio of catalyst to alcohol or by stripping a conventional ethoxylated alcohol. These various specific $C_{17}$–$C_{19}$ ethoxylates give extremely good performance even at lower levels (e.g., about 5% and at the higher levels (about 9%) are sufficiently low sudsing, especially when capped with a low molecular weight ($C_{1-5}$) acid or alcohol moiety, so as to minimize or eliminate the need for a suds-suppressing agent. This is highly desirable since suds-suppressing agents in general tend to act as a load on the composition and to hurt long term spotting and filming characteristics.

(2) Polyethylene glycols having molecular weights of from about 1,400 to about 30,000, e.g., 20,000; 9,500; 7,500; 6,000; 4,500; 3,400; and 1,450. All of these materials are waxlike solids which melt between 110° F. and 200° F.

(3) The condensation products of 1 mole of alkyl phenol wherein the alkyl chain contains from about 8 to about 18 carbon atoms and from about 4 to about 50 moles of ethylene oxide. Specific examples of these nonionics are the condensation products of 1 mole of decylphenol with 40 moles of ethylene oxide; the condensation product of 1 mole of dodecylphenol with 35 moles of ethylene oxide;

the condensation product of 1 mole of tetradecylphenol with 25 moles of ethylene oxide; the condenstion product of 1 mole of hectadecylphenol with 30 moles of ethylene oxide, etc.

(4) Polyoxypropylene, polyoxyethylene condensates having the formula $$HO(C_2H_4O)_x(C_3H_6O)_y(C_2H_4O)_xH$$

where y equals at least 15 and $(C_2H_4O)x+x$ equals 20% to 90% of the total weight of the compound and the molecular weight is from about 2,000 to about 10,000, preferably from about 3,000 to about 6,000. These materials are, for example, the Pluronics which are well known in the art.

(5) The compounds of (1) which are capped with propylene oxide, butylene oxide and/or short chain alcohols and/or short chain fatty acids, e.g., those containing from 1 to about 5 carbon atoms, and mixtures thereof.

Preferred surfactants are those having the formula $RO\text{-}(C_2H_4O)_xR^1$ wherein R is an alkyl or alkylene group containing from 17 to 19 carbon atoms, x is a number from about 6 to about 15, preferably from about 7 to about 12, and $R^1$ is selected from the group consisting of: preferably, hydrogen, $C_{1-5}$ alkyl groups, $C_{2-5}$ acyl groups and groups having the formula $-(C_yH_{2y}O)_nH$ wherein y is 3 or 4 and n is a number from 1 to about 4.

Also preferred are the low sudsing compounds of (4), the other compounds of (5), and the $C_{17-19}$ materials of (1) which have a narrow ethoxy distribution.

In addition to the above mentioned surfactants, other suitable surfactants can be found in the disclosures of U.S. Pat. Nos. 3,544,473, 3,630,923, 3,888,781 and 4,001,132, all of which are incorporated herein by reference.

The Polyacetal Carboxylate

The polyacetyl carboxylates for use herein are more fully described in U.S. Pat. Nos. 4,144,226 and 4,146,495 incorporated herein by reference. The polyacetal carboxylates have the generic formula

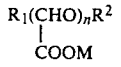

wherein M is selected from the group consisting of sodium and potassium, preferably sodium and $R^1$ and $R^2$ are each a chemically stable group which stabilizes the polymer against rapid depolymerization in alkaline solution.

Any number of chemically reactive groups can be added to the polyacetal carboxylate termini to stabilize the polyacetal carboxylate against rapid depolymerization in an alkaline solution. It is only necessary that the chemically reactive group stabilizes the polyacetal carboxylate against rapid depolymerization in an alkaline solution, and the specific nature of the chemically reactive group is not important in the proper function of the polyacetal carboxylate in its intended use. As an example, suitable chemically stable end groups include stable substituent moieties derived from otherwise stable compounds, such as alkanes, such as methane, ethane, propane, butane and higher alkanes such as decane, dodecane, octadecane and the like; alkenes such as ethylene, propylene, butylene, decene, dodecene and the like; branched chain hydrocarbons such as benzene, toluene, xylene and the like; cycloalkanes and cycloalkenes such as cyclohexane and the like; haloalkanes such as chlorobutane, dichloropentane and the like; alcohols such as methanol, ethanol, 2-propanol, cyclohexanol, sodium phenate and the like; polyhydric alcohols such as 1,2-ethane diol, 1,4-benzene diol and the like; mercaptans such as methane thiol, 1,2-ethanedithiol and the like; ethers such as methoxyethane methyl ether, ethyl ether, ethoxypropane and cyclic ethers such as ethylene oxide, epichlorohydrin, tetramethylene oxide and the like; aldehydes and ketones such as ethanal, acetone, propanal, methylethyl ketone and the like; and carboxylate-containing compounds such as the alkali metal salts of carboxylic acids, the esters of carboxylic acids and the anhydrides. The above listing is intended to be instructive and is not intended to be limited since chemically stable end groups that stabilize the polyacetal carboxylate against rapid depolymerization in alkaline solution include nitrilo groups and halides such as chlorides, bromides and the like. Particularly suitable end groups include alkyl groups and cyclic alkyl groups containing oxygen: such as oxyalkyl groups like methoxy, ethoxy and the like; carboxylic acids such as $-CH_2COOM$,

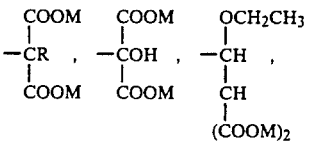

and the like; aldehydes, ethers and other oxygen-containing alkyl groups such as $-OCH(CH_3)OC_2H_5$, $-(OCH_2CH_2)-_{1-4}OH$, $-(CH_2CH_2O)-_{1-4}H$,

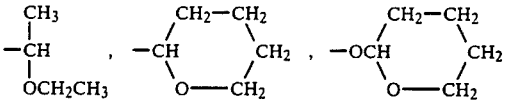

and the like. In the above examples of suitable end groups, M is alkali metal, ammonium, alkanol amine, alkyl groups having 1 to 4 carbon atoms, tetraalkyl ammonium groups and alkanol amine groups having from 1 to about 4 carbon atoms in the alkyl chain, and R is hydrogen or alkyl group of 1 to 8 carbon atoms. As will occur to those skilled in the art in light of the present disclosure, the chemically stable end groups at the polyacetal carboxylate termini can be alike or unlike.

As a further example of the polyacetal carboxylates of the present invention wherein the end groups can be different, one end group can be a polymer, and particularly a polymer with an anionic charge, which permits one or more of the polyacetal carboxylates of the present invention to be appended to the polymer, or on the other hand, the polyacetal carboxylates of the present invention can be the part of a block copolymer having a polymer chain at each of the polyacetal carboxylate termini. Preferred polymers that are anionic or can be made anionic include: polymers of cellulose acetate, cellulose propionate, cellulose acetate butyrate, polyvinyl acetate, polyvinyl alcohol and the like. In the case of an anionic polymer, the polymer can be used to initiate the polymerization to form the polyacetal carboxylates wherein the polymer adds to the termini as one of the chemically stable end groups to stabilize that end of the polyacetal carboxylate against rapid depolymerization in an alkaline solution, and thereafter the other end of the polyacetal carboxylate can be stabilized with a compound such as ethylene oxide or the like, as described above.

In one embodiment of this invention, diethylsodiomalonate or sodiomethylmalonate is used as an initiator to form the polymer. These compounds not only serve to initiate the polymerization, but also the ester adds to the termini as one of the chemically stable end groups to stabilize that end of the polyacetal carboxylate against rapid hydrolysis in an alkaline solution. These compounds can be prepared from the corresponding esters using sodium hydride in a solvent, such as tetrahydrofuran, and techniques known to those skilled in the art.

Accordingly, it can be seen that in one embodiment of this invention the builder mixture contains a water-soluble polyacetal carboxylate having the structure:

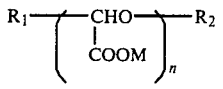

wherein M is selected from the group consisting of alkali metal, ammonium, tetraalkyl ammonium groups and alkanol amine groups having from 1 to about 4 carbon atoms in the alkyl chain; n averages at least 4; and $R_1$ and $R_2$ are individually any chemically stable group which stabilizes the polyacetal carboxylate against rapid depolymerization in alkaline solution.

The number of repeating units, i.e., the value of n, in the polyacetal carboxylate is important since the effectiveness of the polyacetal carboxylate salt as a detergency builder is affected by the chain length. Even when there are as few as four repeating units (i.e., n averages 4), the polyacetal carboxylate salt shows some effectiveness as a sequestrant, chelating agent and builder. Although there is no upper limit to the desired number of repeating units, which may be as high as 400, or even higher, there does not seem to be an advantage to having more than about 200 repeating units. When the number of repeating units exceeds about 100, significant improvement in sequestration, chelation and builder properties is not observed. Thus, it is preferred that the polyacetal carboxylate contain between about 10 and about 200 units, and even more preferred that the polyacetal carboxylate contains between about 50 and about 100 repeating units.

The polyacetal carboxylate can also contain other polymer fragments, and accordingly, the polymer can be a linear homopolymer, the polyacetal carboxylate segments are polymerized with any numer of chain extending agents known to those skilled in the art. It is only necessary that the chain extending agent does not cause the polyacetal carboxylate to rapidly depolymerize in alkaline solution, or become insoluble in water. Either aliphatic or aromatic chain extending agents can be used, but aliphatic chain extending agents are preferred to make the polymer more environmentally acceptable, and aliphatic chain extending agents having from 1 to 4 carbon atoms, such as ethylene oxide or propylene oxide, are especially preferred.

It is important that a copolymer contains at least 4 repeating units (i.e., n averages at least 4) of the acetal carboxylate to insure that the copolymer will effectively sequester calcium and magnesium ions and provide builder properties. It is preferred that the copolymer contain at least 10 repeating units of acetal carboxylate, or more, say 50 or 100 repeating units, for the reasons described above. As will occur to those skilled in the art in light of the present disclosure, having at least 4 acetal carboxylate units in a copolymer prepared by block or graft polymerization techniques should not present a problem, but when acetal carboxylate esters are copolymerized with a chain extending agent, the amount of acetal carboxylate should be at least about 50% by weight, based on the total weight of the polymer, to insure that the polymer will effectively sequester calcium and magnesium ions and retain its builder properties. It is preferred that the amount of acetal carboxylate is 80% by weight, based on the total weight of the polymer, or even higher.

As will occur to those skilled in the art, any number of chain extending agents can be copolymerized with the polyacetal carboxylates of the present invention. It is only necessary that the chain extending agent will provide at least two reactive sites and does not cause the polyacetal carboxylates to depolymerize in alkaline solution. Suitable chain extending agents include: polyhydric alcohols, such as ethylene glycol, propylene glycol and the like; epoxy compounds, such as ethylene oxide, propylene oxide, epihalohydrin epoxysuccinates and the like; aldehydes, such as formaldehyde, acetaldehyde, and the like. It is particularly beneficial when the chain extending agent contains substituent carboxy groups.

Thus, it can be seen that in one embodiment of this invention the builder mixture contains a stabilized water-soluble polymer comprising polyacetal carboxylate segments having the general formula:

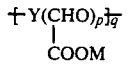

where Y is at least one chain extending agent, preferably alkyl or oxyalkyl having 1 to 4 carbon atoms, p averages at least 4, q is at least 1, and M is selected from the group consisting of alkali metal, ammonium, tetraalkyl ammonium groups and alkanol amine groups having from 1 to about 4 carbon atoms in the alkyl chain. Furthermore, the polyacetal carboxylates having a chain extending agent can be stabilized against rapid depolymerization in alkaline solution by the same techniques used above using suitable reagents or polymers as described above.

The polyacetal carboxylate ester can be converted to the corresponding alkali metal, ammonium, tetraalkyl ammonium or alkanol amine salts by conventional saponification techniques, and such salts are especially useful as a builder in detergent formulations. Since the pH of an automatic dishwashing detergent solution is usually between pH 9 and pH 10, the polyacetal carboxylate salt will not depolymerize rapidly when used as a detergent builder in aqueous solution at normal use concentrations typical of United States home dishwashing practices. However, it is believed that depolymerization does occur between washes, thereby avoiding the spotting troubles associated with other organic detergency builders, so long as the polyacetal carboxylate salt is present in the composition at less than 30%, preferably from about 2% to less than 20%, most preferably from about 5% to about 15%.

Other Ingredients

In addition to the above ingredients it may be desirable, if the product sudses too much, to incorporate one of the many suds-suppressing ingredients disclosed in the above mentioned patents, which have been incorporated by reference, at a level of from about 0.001% to about 10%, preferably from about 0.05% to about 3%. The preferred suds suppressing materials are mono and distearyl acid phosphates; the self-emulsified siloxane suds suppressors of U.S. Pat. No. 4,136,045 by T. W. Gault and Edward John McGuire, Jr., incorporated herein by reference, and mixtures thereof. In general, lower amounts of, or no, suds-suppressors are preferred. Less than 0.2%, preferably less than 0.1% is desirable, more preferably none, for best spotting and filming (S/F) performance, long term.

The compositions should contain less than about 10%, more preferably less than about 5%, and most preferably none of the materials which have a pH greater than 12 at a concentration of 1% in water. Such materials are conventional components of automatic dishwashing compositions such as sodium metasilicate and sodium hydroxide. The content of such materials should be kept to the bare minimum for safety reasons.

Similarly, there should be no more than about 10%, preferably no more than about 5% and preferably none of the other organic sequestering builders in the compositions. The presence of the other organic builders hurts the S/F performance of these compositions as disclosed in U.S. Pat. No. 4,199,467 of Novosel et al, being incorporated herein by reference.

China protecting agents including aluminosilicates, aluminates, etc., may be present in amounts of from about 0.1% to about 5%, preferably from about 0.5% to about 2%.

Filler materials can also be present including sucrose, sucrose esters, sodium, chloride, sodium sulfate, etc., in amounts from about 0.001% to about 60%, preferably from about 5% to about 30%.

Hydrotrope materials such as sodium benzene sulfonate, sodium toluene sulfonate, sodium cumene sulfonate, etc., can be present in minor amounts, but, as with other organic materials, their presence is normally minimized.

Dyes, perfumes, crystal modifiers and the like can also be added in minor amounts.

As used herein, all percentages, parts and ratios are by weight unless otherwise stated.

The following Examples illustrate the invention and facilitate its understanding.

Spotting and Filming

Four test glasses (Libbey Safe Edge 10 oz. tumblers No. 553) were added in predetermined (the same for all tests) positions in the upper rack. Prior to placement in the machine, two of the test glasses were soiled with a thin film of milk by coating them with refrigerated whole milk. Thirty-five grams of 4:1 weight mixture of shortening and dry milk were placed in a 50 ml. beaker and inverted in the top rack of the dishwasher. The required amount of detergent product was then added to the dispenser cup. Subsequently, at the main wash of the cycle, 7.5 grams more of the 4:1 weight mixture of shortening and dry milk were added. The test consisted of nine washer cycles conducted in General Electric dishwashers whereby four glasses from each dishwasher were graded at the end of each cycle. The levels of spotting and filming performance were appraised with the aid of a 1–10 scale of photographic standards (separate standards for spotting/filming) wherein 1 represents a completely unacceptable level of performance and 10 represents a performance whereby residual spotting and filming do not occur.

DEMONSTRATIVE EXAMPLE SHOWING EFFECT OF LEVEL OF THE POLYACETAL CARBOXYLATE

| Composition | % | | | | | |
|---|---|---|---|---|---|---|
| | A | B | C | D | E | F |
| Sodium tripolyphosphate | 26.5 | 0 | 22 | 11 | 0 | 45 |
| Trisodium orthophosphate (from CITSP) | 8.9 | 8.9 | 16.2 | 16.2 | 8.9 | 8.9 |
| Sodium silicate, % solids | 14.2 | 14.2 | 14.5 | 14.5 | 13.7 | 13.7 |
| % $SiO_2$ | 10.2 | 10.2 | 10.2 | 10.2 | 10.2 | 10.2 |
| $Na_2CO_3$ | 0 | 0 | 2.0 | 2.0 | 0 | 0 |
| HA 433[1] | 5.5 | 5.5 | 3.0 | 3.0 | 2.7 | 2.7 |
| HA 430[2] | | | 5.0 | 5.0 | | |
| Polyacetal carboxylate[3] | 0 | 26.5 | 0 | 11 | 45 | 0 |
| Available chlorine (from CITSP--chlorinated trisodium orthophosphate) | 0.7 | 0.7 | 1.3 | 1.3 | 0.7 | 0.7 |

[1]Propylene glycol/propylene oxide/ethylene oxide condensate, M.W. approximately 4,000, approximately 26% ethylene oxide + 3% monostearyl acid phosphate

[2]Same as above without the monostearyl acid phosphate.

[3]$CH_3CH_2-O-\underset{\underset{CH_3}{|}}{CH}-O-\underset{\underset{COONa}{|}}{[CHO]_{87}}-\underset{\underset{CH_3}{|}}{CH}-O-CH_2CH_3$ These compositions were tested for spotting and filming with the following results.

The water in this test was at 130° F. and the hardness was 15 grains per gallon. Twenty-four grams of product were used, except for Compositions E and F where 2 cups each containing 24 grams of product, were used. Nine cycles of soiling and cleaning were completed.

These test results were as follows:

| Composition | A | B | C | D | E | F |
|---|---|---|---|---|---|---|
| Spotting/Filming Grades (Average grade on the ninth cycle) | 8.5/6.0 | 8.4/7.3 | 8.5/5.0 | 8.9/7.3 | 6.6/7.6 | 7.9/7.3 |

As can be seen from the above, a level of less than about 30% of polyacetal carboxylate provides better spotting as compared to higher levels and the lower amounts provide very much improved filming results in hard water with orthophosphate present.

When in the above Examples, the following surfactants are substituted for the indicated surfactants substantially equivalent results are obtained: Plurafac RA-40 (a $C_{13.3}$ linear alcohol ethoxylated with about 3.86 moles of ethylene oxide and the condensation product thereof reacted with about 9 moles of propylene oxide); a mixture of 14 and 15 carbon alcohols ethoxylated with 17 moles of ethylene oxide and then propoxylated with 3 moles of propylene oxide; a mixture of $C_{12}$ and $C_{13}$ alcohols ethoxylated with 6 moles of ethylene oxide and then propoxylated with 6 moles of propylene oxide; a mixture of $C_{14}$ and $C_{15}$ fatty alcohols ethoxylated with 12 moles of ethylene oxide and then propoxylated with 6 moles of propylene oxide; a $C_{15}$ alcohol ethoxylated with 9 moles of ethylene oxide and then capped with a methyl group; polyethylene glycol having a molecular weight of about 4,000; stearic acid condensed with about 9 moles of ethylene oxide; and $C_{18}$ alcohol ethoxylated with about 9 moles of ethylene oxide.

When in the above Examples, sodium or potassium pyrophosphate is substituted for the sodium tripolyphosphate substantially equivalent results are obtained.

What is claimed is:

1. An automatic dishwashing composition providing optimum cleaning; spotting and filming; and physical characteristics consisting essentially of:

(1) from about 20% to about 60% of a detergency builder selected from the group consisting of alkali metal tripolyphosphates, pyrophosphates, orthophosphates, carbonates and mixtures thereof;

(2) from about 10% to about 30% alkali metal silicate solids providing from about 5% to about 15% of $SiO_2$;

(3) a material selected from the group consisting of sodium and potassium dichloroisocyanurates; dichloroisocyanuric acid; 1,3-dichloro-5,5-dimethylhydantoin; N,N'-dichlorobenzoylene urea; paratoluene sulfodichloroamide; trichloromelamine; N-chloroammeline; N-chlorosuccinimide; N,N'-dichloroazodicarbonamide; N-chloroacetyl urea; N,N'-dichlorobiuret; chlorinated dicyandiamide; sodium hypochlorite; calcium hypochlorite; lithium hypochlorite; chlorinated trisodium phosphate; and mixtures thereof; to provide available chlorine at a level of from about 0.5% to about 3%;

(4) from about 1% to about 9.5% of a low foaming nonionic surfactant; selected from the group consisting of (a) the condensation product of 1 mole of a saturated or unsaturated, straight or branched chain alcohol or fatty acid containing from about 10 to about 20 carbon atoms with from about 4 to about 50 moles of ethylene oxide;

(b) polyethylene glycols having molecular weights of from about 1,400 to about 30,000;

(c) the condensation products of 1 mole of alkyl phenol wherein the alkyl chain contains from about 8 to about 18 carbon atoms and from about 4 to about 50 moles of ethylene oxide;

(d) polyoxypropylene, polyoxyethylene condensates having the formula $$HO(C_2H_4O)_x(C_3H_6O)_y(C_2H_4O)_xH$$

where y equals at least 15 and $(C_2H_4O)_{x+x}$ equals 20% to 90% of the total weight of the compound and the molecular weight is from about 2,000 to about 10,000;

(e) the compounds of (a) which are capped with propylene oxide, butylene oxide, and/or short chain alcohols, and/or short chain fatty acids; and (f) mixtures thereof;

(5) from about 1% to about 30% of a stabilized water-soluble polymer consisting essentially of polyacetal carboxylate segments having the structure $$\left[\begin{array}{c}CHO\\ |\\ COOM\end{array}\right]_n,$$

wherein M is selected from the group consisting of alkali metal, ammonium tetraalkyl ammonium and alkanol amine groups having from 1 to about 4 carbon atoms in the alkyl and alkanol chains; n averages at least 4; and the total number of polyacetal carboxylate segments are at least 50% by weight of the total polymer;

said composition having a pH of from about 9 to 10.9 at 2,500 ppm and being substantially free of materials having a pH of 12 or more at a concentration of 1% in water and other organic chelating builders.

2. The composition of claim 1 containing from about 5% to about 25% of carbonate, orthophosphate, or mixtures thereof.

3. The composition of claim 1 which is completely free of materials having a pH of 12 or more at a concentration of 1% in water.

4. The composition of claim 3 containing from about 3% to about 8% of a low foaming nonionic surfactant.

5. The composition of claim 3 containing from about 20% to about 35% of sodium tripolyphosphate.

6. The composition of claim 3 wherein the available chlorine is in the form of sodium dichloroisocyanurate dihydrate.

7. The composition of claim 1 which is completely free of organic chelating builders other than the polyacetal carboxylate.

8. The composition of claim 7 containing the polyacetal carboxylate at a level of from about 2% to less than 20%.

9. The composition of claim 8 containing from about 5% to about 15% of the polyacetal carboxylate.

* * * * *